United States Patent [19]

Backström et al.

[11] 3,978,798

[45] Sept. 7, 1976

[54] FUZE MECHANISM HAVING INTEGRATED SAFETY FUNCTIONS

[76] Inventors: Kaj Backström, Bergstigen 21B, 182 74 Stocksund; Rolf V. Grahn, Solrosvagen 10; Per O. T. V. Hedenmark, Bergius Vag 4, both of 644 00 Torshalla; Kjell G. Öhrstedt, Hagalundsvagen 42 D, 653 41 Karlstad, all of Sweden

[22] Filed: Nov. 4, 1974

[21] Appl. No.: 520,860

[30] Foreign Application Priority Data

Nov. 9, 1973 U.S.S.R. ..... 151961

[52] U.S. Cl. ..... 102/71; 102/78; 102/84

[51] Int. Cl.[2] ..... F42C 9/02

[58] Field of Search ..... 102/71, 78, 80, 84

[56] References Cited

UNITED STATES PATENTS

| | | | |
|---|---|---|---|
| 1,496,271 | 6/1924 | Junghans | 102/80 |
| 1,523,073 | 1/1925 | Junghans | 102/71 X |
| 2,814,251 | 11/1957 | Kuhn et al. | 102/84 |
| 3,162,126 | 12/1964 | Weber et al. | 102/78 |
| 3,345,947 | 10/1967 | Combourieux | 102/84 X |
| 3,616,756 | 11/1971 | Simmen et al. | 102/71 X |
| 3,779,169 | 12/1973 | Backstein et al. | 102/80 X |

FOREIGN PATENTS OR APPLICATIONS

| | | | |
|---|---|---|---|
| 1,200,176 | 9/1965 | Germany | 102/84 |
| 597,927 | 2/1948 | United Kingdom | 102/84 |

*Primary Examiner*—David H. Brown
*Attorney, Agent, or Firm*—McCormick, Paulding & Huber

[57] ABSTRACT

A fuze mechanism for projectiles and the like is provided with a number of integrated safety catches which must be successively released before the fuze may be detonated. A firing pin lock cannot be released until the fuzing time has first been set. Release of the lock and the firing pin is also prevented by a centering piston response to inertial forces at the time the projectile is launched and another piston controlled by the clockwork of the fuze. The clockwork may be overridden by mechanism detecting impact of the projectile to permit detonation in a period of time shorter than the fuzing time.

9 Claims, 8 Drawing Figures

FUZE MECHANISM HAVING INTEGRATED SAFETY FUNCTIONS

The present invention refers to a fuze mechanism for projectiles and the like which is of the type containing a clockwork which when the projectile or the like is fired is put into operation and thereby contributes to an arming of the fuze and it may also contribute to a subsequent firing of the fuze charge for the projectile.

There are very strong demands on safety for a fuze in order to avoid a premature firing of the projectile due to careless handling thereof, strains connected to the launching or obstacles in the projectile path. Prior Art fuzes are lacking in many respects as concerns the safety functions, and such fuzes generally have to be completed with means for providing one or more safety functions before being permitted for ball-ammunition. It is often difficult or even impossible to complete or modify an existing fuze so as to fulfil all demands on safety and even if such completing or modifying may take place this is a time and costs consuming and perhaps complicated action at the same time as the completed or modified fuze may obtain unnecessary large outer dimensions.

In order to give a satisfactory safety a fuze ought to be formed with at least the following safety functions:

a. Transport and handling safety catch in order to prevent release in case of careless transport or handling b. Blasting cap safety catch in order to prevent a firing of the main charge due to unintentional firing of the detonation cap, c. Charge safety catch to prevent release at charge, d. Bore and mask safety catch to prevent release while the projectile is passing through the bore of the weapon and during the first part of the path of the projectile where it may pass through brush wood or similar and e. A path safety catch to prevent release during the following path of projectile before the predetermined time for release has come to its end.

In some cases the fuze must be formed with further means for providing safety functions like impact safety device, muzzle safety devise etc.

Basis for the present inventin is the problem to provide a fuze mechanism of the above mentioned kind, which as a single unit includes means for the above under points a–e mentioned and other necessary safety functions. When performing the invention it has been considered that the safety functions should be of integrated kind, so that the arming or release of the different safety catches take place successively after each other and so that in this way they co-act to form a fuze mechanism having a multi-safety action.

The new fuze mechanism according to the invention which has solely mechanical safety units is simple and reliable in action, and the basic structure thereof is so flexible that it maybe adapted to many different fields of use. The fuze mechanism may be formed with a mechanical, electrical or electronic clockwork without substantial change of the remaining structure of the fuze. In its most simple performance the fuze may be formed only for clock firing or it may in a modified embodiment be formed for combined clock and impact firing. The fuse mechanism is also so formed that the time for full tempering may be varied within as wide limits as between 10 and 80 seconds. The bore and mask safety device may be performed in combination with the run time, so that the bore and the mask safety time is proportional to the said time. The fuse mechanism may also be formed and adjusted for direct impact firing and/or for delayed impact firing.

Further characteristics of the invention will be evident from the following detailed description of a number of embodiments of the inventions. In the description reference is made to the accompanying drawings, in which.

Figure 1:
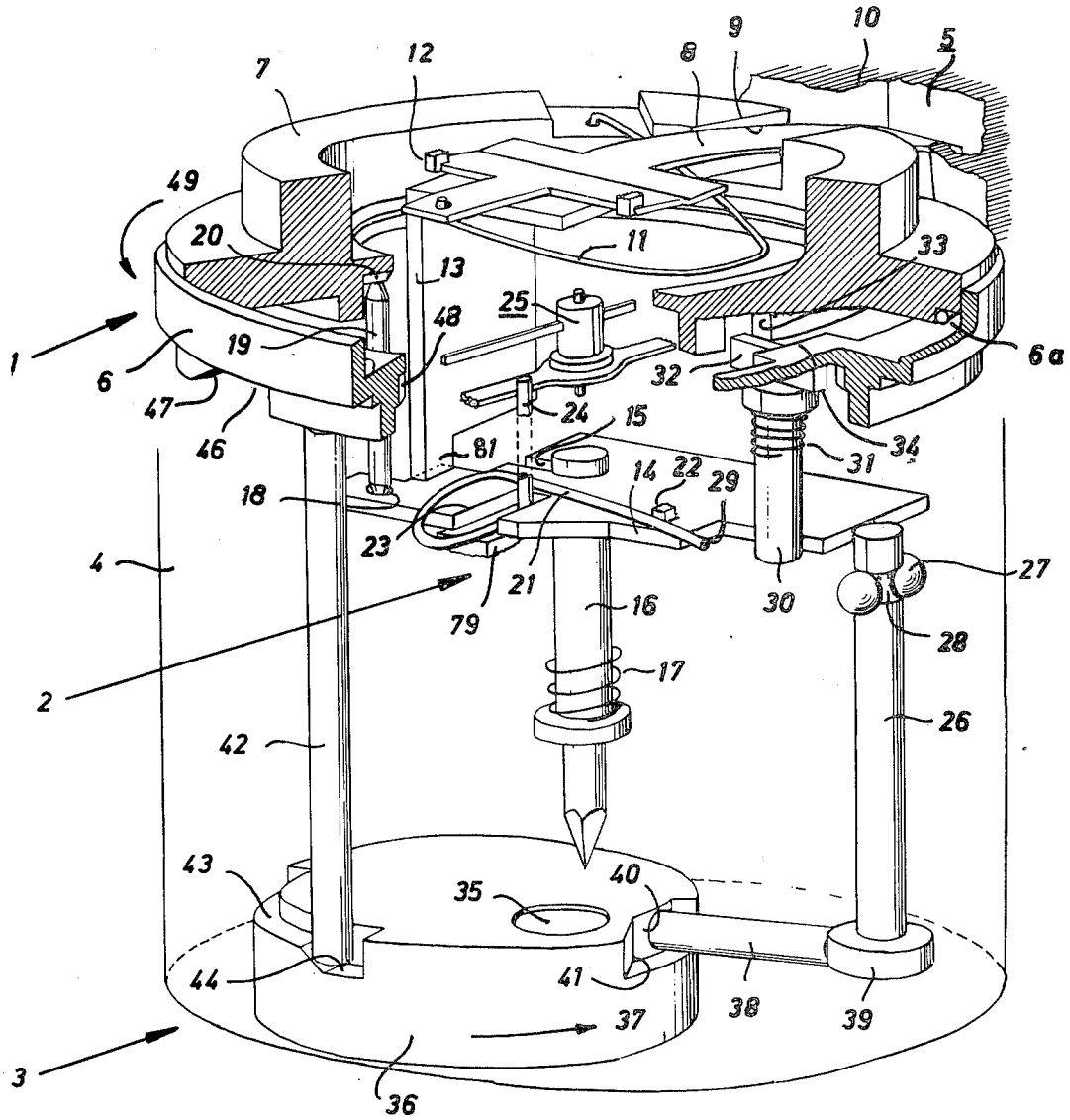
FIG. 1 is a diagramatically and in a partly broken section showing a first embodiment of the fuze mechanism according to the invention in its fully secured position.

The fuze mechanism shown in figures generally comprises a time adjusting unit 1, a release unit 2 and a firing unit 3. The three main parts intimately co-act with each other and form an integrated unit. The different parts of the fuze are enclosed in a mainly cylindrical housing 4 which in the drawings is only indicated schematically for the sake of clearness. When used the fuze is mounted in a projectile or the like and with the time adjusting unit it engages the top 5 which may e.g. be the nose of the projectile and which is only partly indicated in the drawings.

The time adjusting unit 1 comprises a cog ring 6 which supports and with its periphery encloses a timing ring 7 by means of which the firing interval of the fuze may be adjusted. Between the cog ring 6 and the timing ring 7 there is a coil spring **6*a* the purpose of which is to increase the friction between the said two rings. The timing of the fuze occurs in conventional way by rotating the top 5, and to provide a connection between the top 5 and the fuze a follower 8 is mounted in the upper part of the fuze so as to project with an extended part thereof out through a slot 9 in the timing ring 7 and into a corresponding groove 10 in the top 5. The purpose of the follower 8 is to prevent a change of an adjusted time which may occur if the timing ring 7 rotates in relation to the cog ring 6 in connection with the launching. A spring 11 tends to pull the follower 8 in the direction out of engagement with the groove 10 in the top 5, but the follower 8 is kept in this position by means of one or more downwards directed shoulders 12 in a cap 83 (see FIGS. 7 and 8) which is mounted on top of the ring 7. The follower 8 is also resilient and is formed so that it tends to lose contact with the shoulders 12 at the underside of the cap 83 due to its own spring force against the said cap. In order to prevent the follower 8 from moving downwards out of engagement with the shoulders 12 it is supported by an angularly formed follower releaser 13 which is mounted axially moveable in the fuze housing 4. The follower releaser 13 rests with its lower edge 81 against a horizontally moveable lock, the firing pin lock 14, which in the position shown in FIG. 1 is locked against a movement releasing the follower releaser 13**. In an open slot 15 the firing pin lock 14 carries the firing pin 16 which for this purpose is formed with a corresponding neck. The firing pin 16 is axially moveably mounted in the housing 4 and is biased in the direction downwards by a spring 17 which with its upper end engages the fuze housing 4 as shown for example in FIG. 7. The slot 15 is parallel with the moving direction of the firing pin lock 14, and when moving the firing pin lock 14 towards the firing position the said firing pin lock is pulled out of the neck of the firing pin 16 which is thereby released for movement downwards.

The firing pin lock 14 is biased radially outwards by a spring 21 which with one end engages a shoulder 22 of the fuze housing 4 and with its other end engages a slot 23 of the firing pin lock. The spring 21 at one end has a vertically upwards directed part 24 which in the safety position locks some part of a clockwork 25 which in the drawings is diagramatically shown only as a clockwork fly.

For blocking, the firing pin lock 14 is formed with a bore 18 in which a lock ring piston 19 engages with a tapered end thereof. The lock ring piston 19 is axially moveable in the fuze housing 4 and the likewise tapered upper end thereof engages a shoulder 20 at the under edge of the timing ring 7. To provide a release of the lock ring piston 19 and thereby a release of the firing pin lock 14, the shoulder 20 of the timing ring 7 has a limited length so that the lock ring piston after some rotation of the timing ring may move upwards a distance great enough for releasing of the firing pin lock 14.

The firing pin lock 14 is prevented from moving outwards to release the firing pin 16 by a centering piston 26 which is axially moveably mounted in the fuze housing 4 and which is kept in a secured position by a couple of spring biased balls 27 engaging a groove 28 of the center piston. The balls 27 are engaging the groove 28 with such a spring force that the centering piston 26 may only move downwards against the action of the spring biased balls at an acceleration movement of a magnitude which is only present when the projectile is launched. When launching the projectile the centering piston 26 is thereby moved downwards, and the firing pin lock 14 which is thereby released moves radially outwards to the position shown in FIG. 2. The firing pin lock may however only move a limited distance since a shoulder 29 thereof engages the under edge of a clock ring piston or stop 30 which prevents a movement of the firing pin lock as far as to release the firing pin. The clock ring piston 30 is mounted axially moveable in the fuze housing 4 and it is biased in the direction upwards by a spring 31. At its upper end the clock ring piston 40 is formed with a head 32 which may engage a downwardly open groove 33 in the timing ring 7. For preventing a premature movement upwards of the clock ring piston 30 into the timing ring groove 33 the cog ring 6 has a radially inwards directed shoulder 34 which after a rotation of the cog ring 6 as far as to the position shown in FIG. 3 releases the clock ring piston 30 for movement upwards. The groove 33 of the timing ring 7 is provided in a position corresponding to the firing time zero for the fuze. Therefore the clock ring piston 30 cannot move upwards thereby releasing the firing pin lock 14 and subsequent the firing pin 16 until the time interval of the fuze has come to its end.

The lock ring piston 19 blocks the firing pin lock 14 as long as the fuze is adjusted at time zero. If in this position the clock work for any reason should start in spite of the fact that the firing pin lock 14 has not released at its first step the situation occurs that the timing ring 7 over the follower 8 is still engaging the top 5 at the same time as the cog ring 6 begins to rotate actuated by the clock work 25. The clock work thereby has to overcome the friction between the cog ring 6 and the timing ring 7 provided by the friction spring 6*a*. This friction torque is less than the one present between the top and the fuze housing. Therefore the shoulder 34 will be moved away and the clock ring piston 30 releases and moves up into the groove 33 of the timing ring 7. If the projectile should now be launched the firing pin lock 14 does still not release due to the blocking of the lock ring piston 19. If there was no such blocking the fuze should release. Such a situation might occur due to defects of some parts, material faults or overlookings in connection to mounting and checking of the fuze.

The detonation of the projectile is accomplished by means of a blasting cap 35 or the like which is eccentrically mounted in a rotor 36 which in turn is mounted in the fuze housing 4 eccentric in relation to the centrally located firing pin 16. The blasting cap 35 is mounted in such position in the rotor 36 that in armed position it will be located straight under the firing pin 16. The rotor 36 is spring biased for rotation, so that it tends to move in the direction along the arrow 37. It is however prevented from moving in this direction both by a rotor piston 38 which with one end engages a head 39 at the lower end of the centering piston 26 and with the other end engages a recess 40 of the rotor having a sloping edge 41, and by a second vertically moveable rotor piston 42 which with its lower end engages and co-acts with a second recess 43 of the rotor and which with its upper end engages the lower edge of the cog ring 6. As best evident from FIG. 3 the second recess 43 of the rotor 36 has two downwards directed end cavities 44 and 45, one of which provides a locking of the rotor in the safety position while the second cavity provides a locking of the rotor in the armed position. For making it possible to move the second rotor piston 42 upwards, the end cavity 44 has a sloping edge which at rotation of the rotor along the arrow 37 provides an upwards directed force component against the rotor piston, and further the lower edge of the cog ring 6 has a recess 46 up into which the second rotor piston 42 may be moved before a sloping edge 47 at the opposite end of the said recess 46 once again forces the piston 42 downwards into locking engagement with the end cavity 45 of the rotor.

The operative action of the fuze is accomplished by the clockwork 25 which may be of any kind like an ordinary mechanical clockwork, a little electric motor or the like. Irrespective of which type of clockwork is used this engages inner cogs 48 of the cog ring 6 so as to cause the cog ring 6 and the timing ring 7 to rotate along the arrow 49.

When putting the fuze together it is foreseen that the cog ring 6 is mounted so that the shoulder 34 thereof keeps the clock ring piston 30 in its down position, whereby at the same time the second rotor piston 42 is kept in its down position in the end cavity 44. Further, the timing ring 7 is mounted in relation to the cog ring 6 so that the groove 33 of the timing ring is located on line with the head 32 of the clock ring piston 30 as shown in FIG. 1. This position corresponds to the time zero or the firing moment, which time is marked at the outside of the top 5. The firing interval is adjusted by rotating the top 5 whereby only the timing ring 7 is rotated while the fuze housing 4 is kept fixed in the fuze body and whereby the cog ring 6 is prevented from rotating because of the engagement between its cogs 48 and the clockwork 25. The fuse thus timed is secured by serveral different safety functions. The clock work cannot start since it is blocked by part 24 of the spring 21. The timing ring cannot be released from the top until the follower 8 is pulled out of the groove 10 of the top 5 (see FIG. 1). The follower 8 cannot be moved until the follower releaser 13 has moved downwards, and the follower releaser 13 cannot be moved downwards until the firing pin lock 14 has moved radially outwards and this is in turn prevented by the centering piston 26 which is blocked by the spring biased balls 27. In the non-timed state the firing pin lock 14 is further blocked against movement radially outwards by the lock ring piston 19 which due to the shoulder 20 engages the bore 18. Not until the fuze is timed or the timing ring 7 is rotated from its zero position shown in FIG. 1 does this so called transport and handling safety catch release so that the fuze may be put into action. This occurs when firing the projectile, whereby the acceleration movement provides a forcing downwards of the centering piston 26 whereby the upper end thereof releases the firing pin lock 14 and the said lock is moved so far that its shoulder 29 engages the clock ring piston 30. Thereby the following two situations occur:

a. The displacement of the firing pin lock 14 releases the lower end 81 of the follower releaser 13 and the releaser 13 is lowered some distance and the follower 8 which is preferably resiliently forced against the cap of the timing ring 7 is likewise forced some distance inwards so as to become released from the shoulders 12, whereby the spring 11 pulls the follower 8 out of the groove 10 of the top 5.

b. At the same time as the firing pin lock 14 is moved the spring 21 is also moved which at a certain moment takes a position straight in front of a recess in the fuze housing 4 one edge 79 of which is shown in the drawings, and the spring 21 which is preferably prestressed is with part 24 thereof forced at first in the horizontal direction and then down into the said recess so as to release the clockwork 25 which immediately starts its function and begins to rotate the cog ring 6 by engagement of the cogs 48 thereof. Thanks to the friction spring *6a*, the cog ring 6 and the timing ring 7 form a coacting unit which is rotated as a unit by the clockwork 25.

Figure 2:
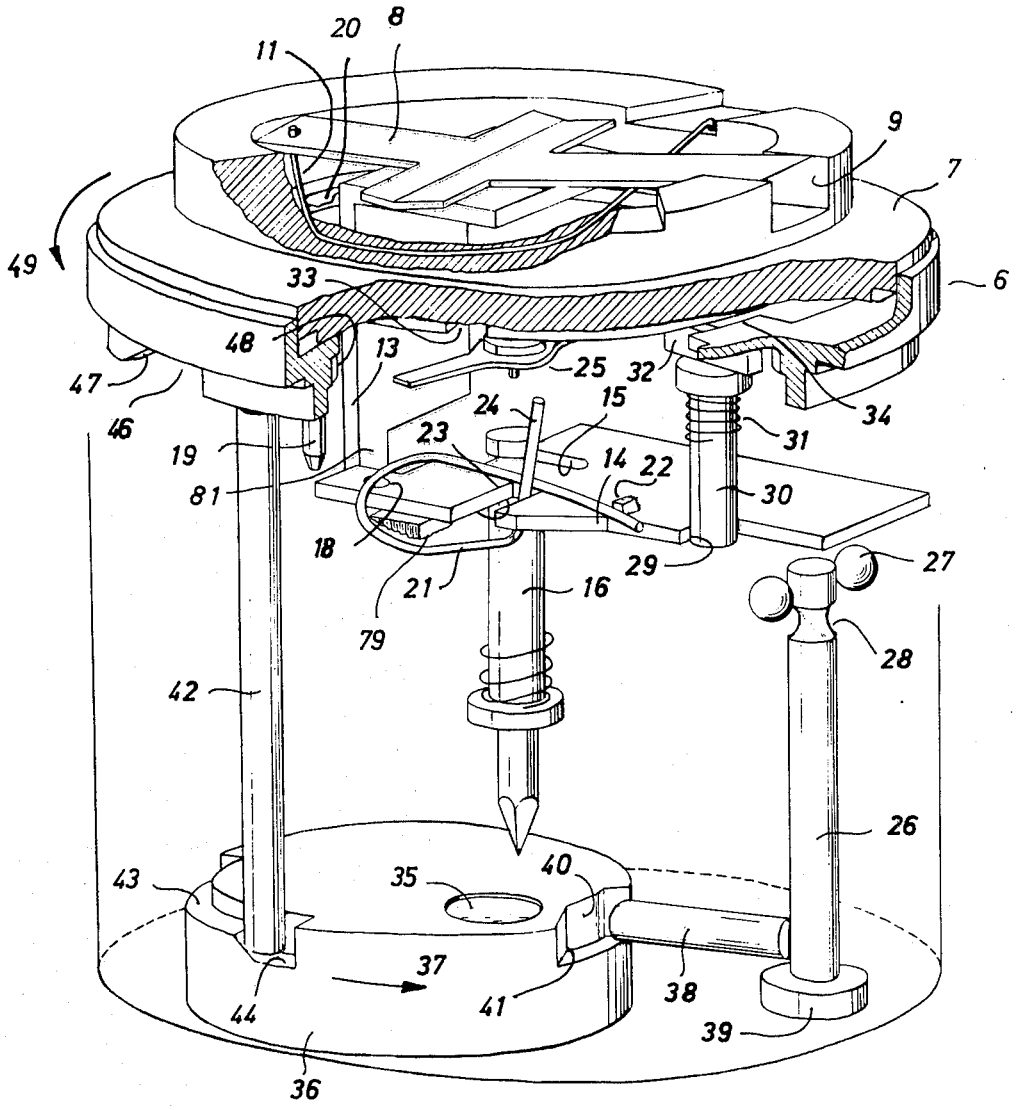
FIG. 2 is showing the fuze mechanism according to FIG. 1 after firing but before the bore and mask safety devices have released.

The movement downwards of the centering piston 26 also releases the head 39 of the centering piston from the first rotor piston 38 which may thereafter freely move out of the recess 40 of the rotor 36 by the action of the sloping edge 41 thereof. The rotor is however still blocked by the second rotor piston 42 and there is no rotation of the rotor towards armed position. The described position, in which the firing pin 16 is still retained in the firing pin lock 14 is illustrated in FIG. 2. In this position the bore safety catch formed by the shoulder 34 of the cog ring 6 still retained in blocked position by the clock ring piston 30 is not yet released.

As soon as the cog ring shoulder 34 lets free the head 32 of the clock ring piston 30, the bore safety catch is released and the lock ring piston 30 is with its head 32 forced against the underside of the timing ring 7, but the firing pin lock 14 cannot be released until the head 32 of the clock ring piston 30 is forced up into the groove 33 at the under side of the timing ring 7.

The mask security catch for the projectile is provided by the underside of the cog ring 6 which keeps the second rotor piston 42 in its forced down position in which it locks the rotor 36. The location of the recess 46 at the under side of the cog ring 6 and the speed of the clockwork determine the time over which the mask security catch is acting. When the unit of cog ring 6 and timing ring 7 has rotated until the second rotor piston 42 may be forced up into the recess 46 at the under side of the cog ring 6 the mask security catch is released and the rotor 36 is rotated as shown by the arrow 37 due to its spring action until the second rotor piston 42 stops its movement straight in front of the end cavity 45. After a further short rotation of the cog ring 6 the second rotor piston 42 is forced down into the end cavity 45 thereby blocking the rotor in the armed position and preventing any further rotation of the rotor in either direction. In this position which is illustrated in FIG. 3 the fuze is completely armed and the blasting cap 35 is located straight under the firing pin 16.

Now there only remains a release of the path safety catch and this release is initiated after the predetermined time has passed and is effected in that the groove 33 at the under side of the timing ring 7 comes into position above the head 32 of the clock ring piston 30, whereby the clock ring piston 30 is forced upwards thereby releasing the firing pin lock 14 which actuated by the spring 21 is moved a further distance outwards so that the firing pin 16 is released from the firing pin lock 14 and by the action of the spring 17 is forced downwards, whereby the firing pin 16 hits the blasting cap 35 which is fired and in turn brings the projectile to detonate.

For any specific speed of the clockwork the period between firing of the projectile and detonation is determined by the angle over which the tempering ring 7 is rotated in relation to the cog ring 6, and this period, the timing period, may with great accuracy be adjusted within rather wide limits. If it is desired to prolongate the timing period over what is possible by rotating the timing ring 7 this may be done by substituting the cog exchange in the clockwork or by substituting the clockwork by a slower one.

Figure 3:
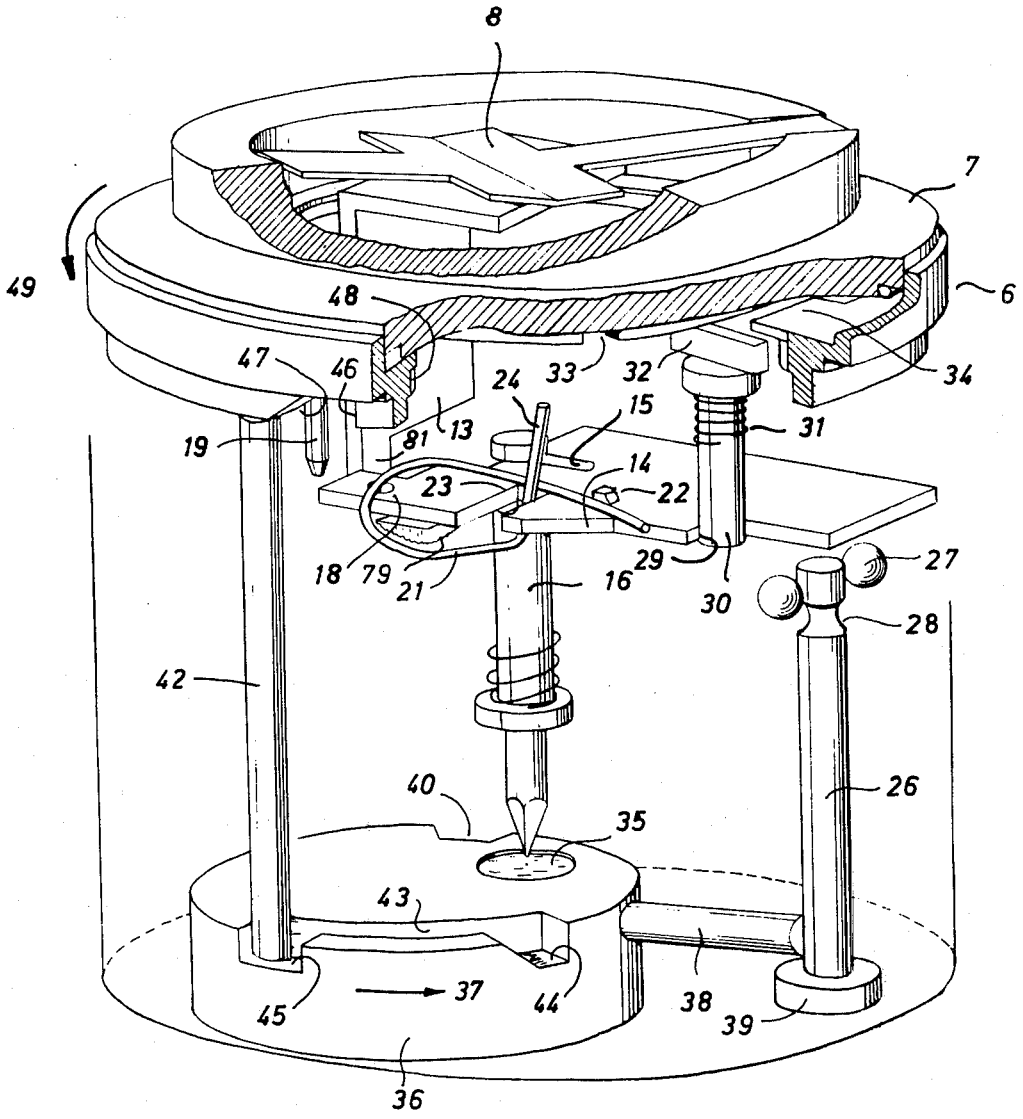
FIG. 3 is showing the fuze mechanism according to FIG. 1 in its fully armed position.
Figure 4:
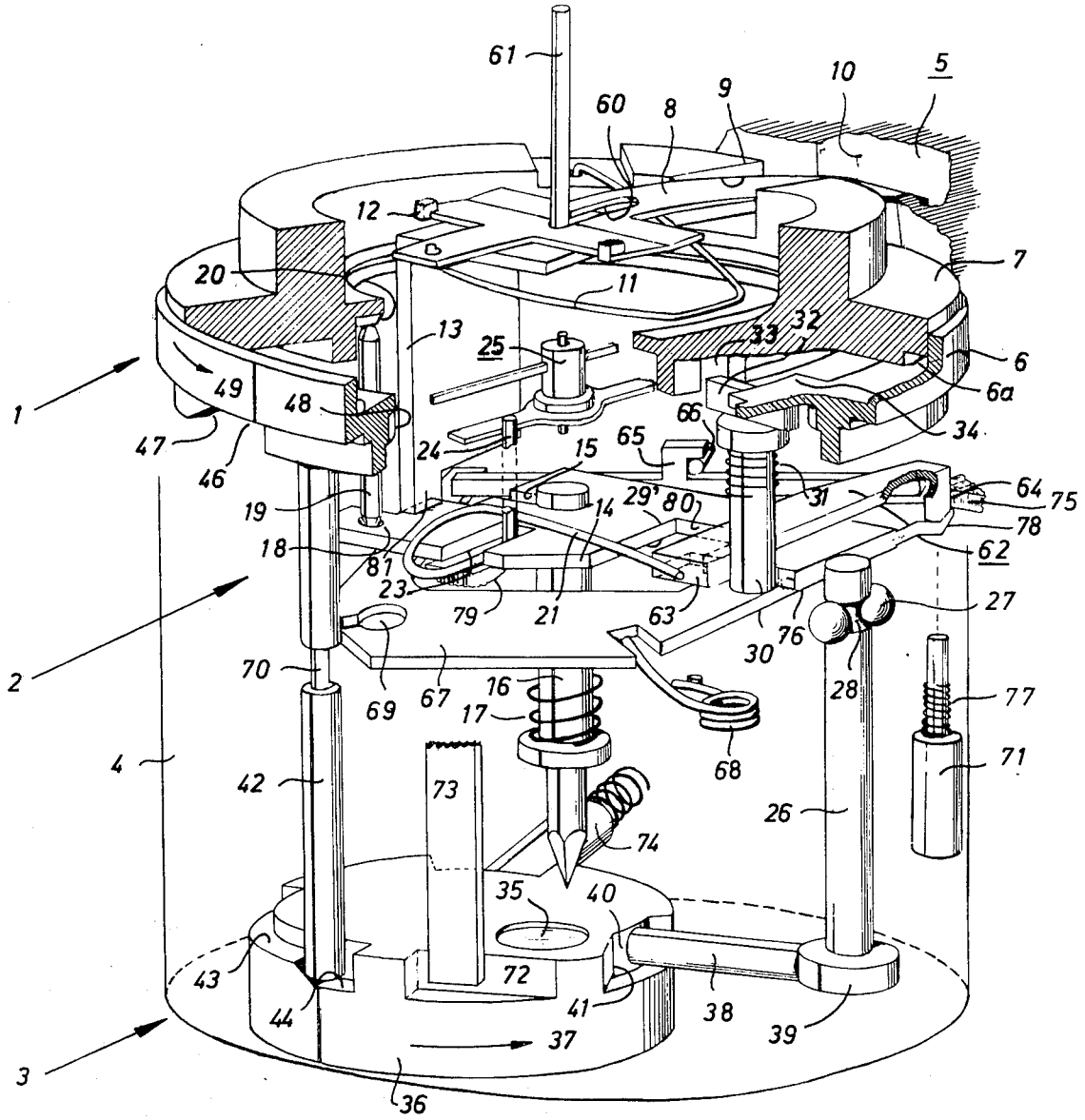
FIGS. 4, 5 and 6 are likewise schematical and partly broken views of a second embodiment of the invention in a secured position, a fired position before release of the bore and mask safety devices and in fully armed position respectively.
Figure 5:
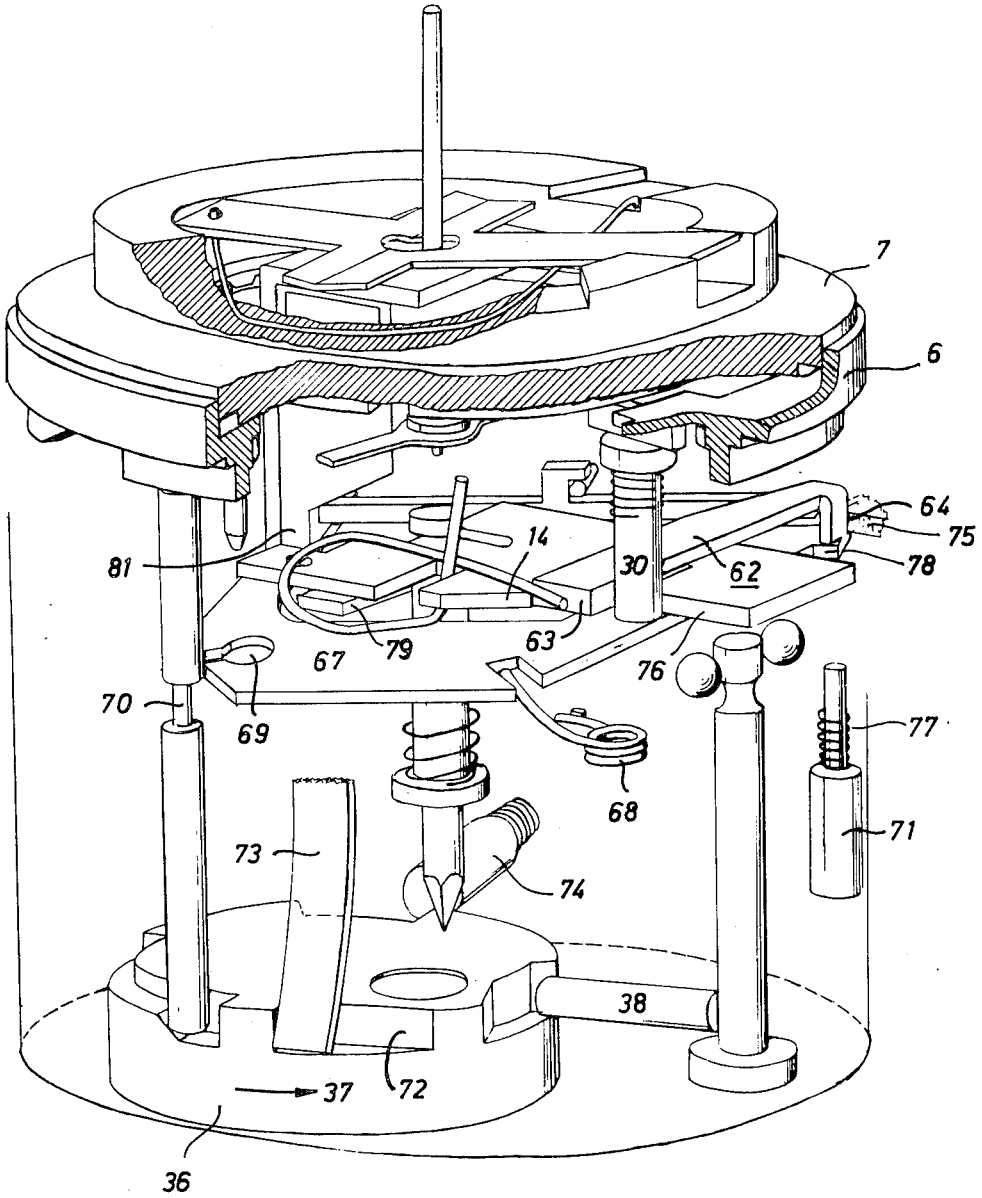
Figure 6:
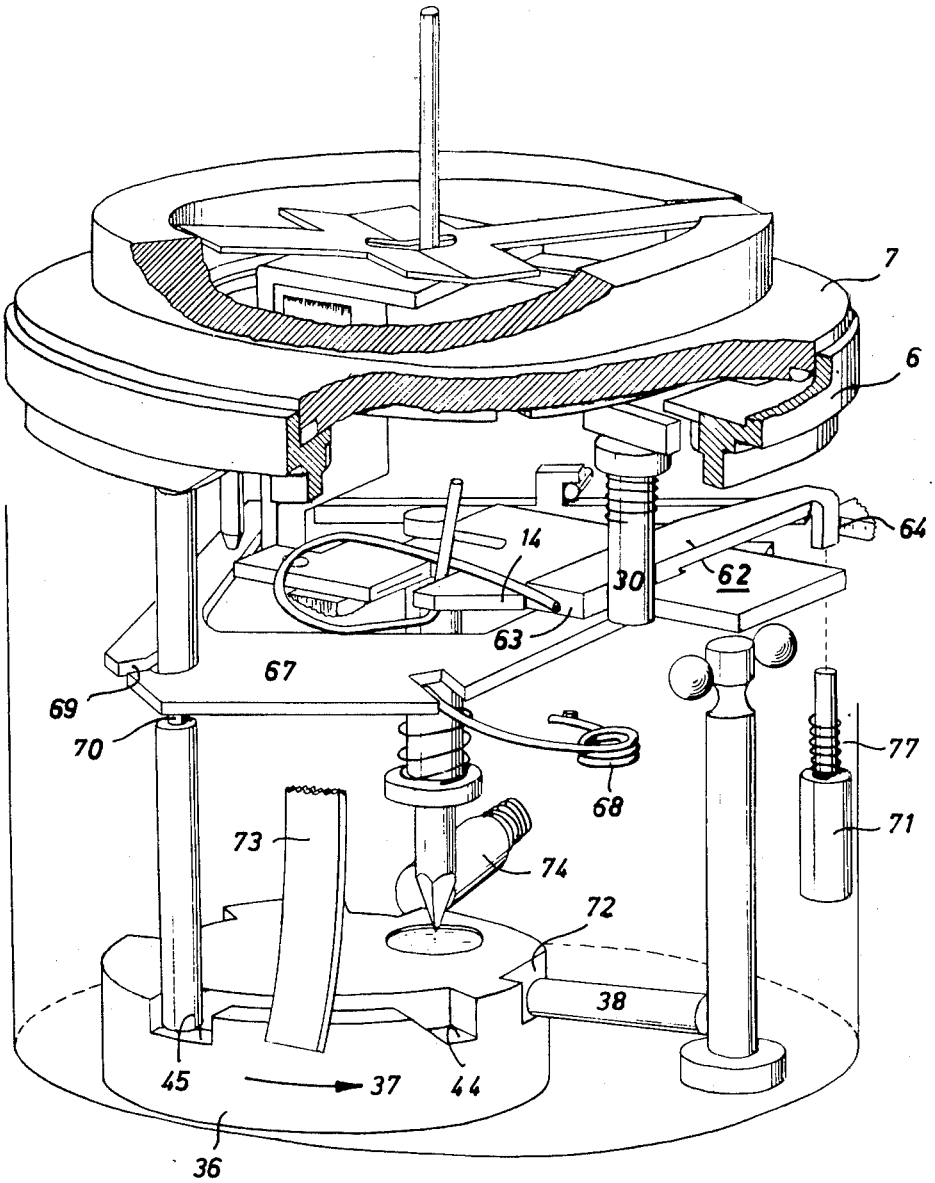

The fuze described in connection to FIGS. 1–3 is a sole time fuze which in case of a hit or impact before the expiration of the adjusted path period will not detonate. To avoid this the fuze according to the invention may in addition to the above described functions also be formed for impact fuzing, whereby the fuze may be brought to release even if the path safety catch provided by the clockwork has not released for any reason. For some purposes only an impact function is wanted, and in this case the clockwork has fulfilled its object in that the mask safety catch has released. Such a modified embodiment of the invention is illustrated in FIGS. 4, 5, and 6. This embodiment of the invention substantially corresponds to the one shown in FIGS. 1–3, and in the following only the parts thereof providing the impact detonation will be described. The figures illustrate two alternative embodiments of the impact fuze mechanisms which may be used together with each other but which are generally used separately.

In the first alternative embodiment which is shown in FIG. 4 the follower 8 is formed with a slot 60, and through said slot extends an impact pin 61 which with one end engages the upper horizontal part of the follower releaser 13 and with the opposite end projects out through the top. The impact pin 61 forms the releasing means of the impact fuze mechanism, which mechanism may be puut into action after the transport and handling safety catch, the charge safety catch, the bore safety catch and the mask safety catch have released but before the clockwork providing the path safety catch has released. In this embodiment of the invention the shoulder 29' which corresponds to the shoulder 29 in the previously described embodiment is positioned somewhat closer to the center of the fuze and in the space between the shoulder 29' and the clock ring piston 30 there is a cross bar 62 which is made of a resilient material and which is located on top of the firing pin lock 14. At one end the cross bar 62 is formed with a downwards directed widened part 63 which by the action of the spring 21 engages the edge 76 of the firing pin lock 14. At its opposite end the cross bar 62 is formed with a downwards directed tongue 64 which by the action of the spring 21 may engage the edge 75 of the fuze housing 4. A rocker 65 which is pivotly mounted about a horisontal axis 66 engages the under side of the cross bar 62 with one end thereof and with its opposite end it is located on top of a rocker catch 67 which is horizontally moveable under the firing pin lock 14. The rocker catch 67 is by means of a spring 68 forced radially outwards in a direction for releasing the blocked end of the rocker 65, but this movement of the rocker catch 67 is prevented since it is engaging the second rotor piston 42. At the end of the rocker catch 67 engaging the second rotor piston 42 it is formed with a key-hole like slot 69 and for co-operation with the said slot, the rotor piston 42 is formed with a neck 70 somewhat under the level of the rocker catch 67 when the rotor piston 42 is in its blocked position. The narrow part of the key-hole slot 69 is slightly wider than the diameter of the neck 70 of the rotor piston 42, and the circular part of the key-hole slot has slightly larger diameter than the rotor piston 42.

The function of the apparatus is the following: When firing the projectile the center piston 26 is forced downwards thereby permitting the firing pin lock 14 to move some distance radially outwards until its shoulder 29' is engaging the cross bar 62 which in turn engages the lower part of the clock ring piston 30. Thereby the follower releaser 13 is released as previously described and the follower 8 is pulled into the fuze away from the groove 10 at the top 5, and concurrently herewith the upwards projecting part 24 of spring 21 is moved downwards thereby releasing the clock mechanism which is put into action. When the shoulder 34 of the cog ring 6 leaves the head 32 of the clock ring piston 30 the bore catch is released and when the cog ring 6 has taken the position to allow a movement upwards of the second rotor piston 42 the mask catch is released thereby the second rotor piston 42 is moved upwards whereby the neck 70 thereof takes a position on line with the rocker catch 67 and by the action of the spring 68 the rocker catch 67 is moved out so that the rotor piston 42 engages the key-hole slot 69 of the rocker catch. Since at this moment both the first rotor piston 38 and the second rotor piston 42 have released their engagement with the rotor 36, this is rotatably actuated by its spring to the armed position which is shown in FIG. 6 whereby the second rotor piston 42 actuated by the sloting edge 47 is once again moved back into its position blocking the rotor 36. The second rotor piston 42 is now also blocking the rocker catch 67 since the neck 70 of the rotor piston 42 is no longer in alignment with the rocker catch 67. The rocker 65 was previously prevented from rotating about its axis 66 so as to provide a raising of one end of the cross bar 62, but from the moment the rocker catch 67 is moved out the corresponding end of the rocker 65 is released for movement downwards. This is accomplished at impact of the projectile in that the impact pin 61 pushes the follower releaser 13 downwards and the follower releaser in turn pushes the corresponding end of the rocker catch 67 downwards whereby the opposite end thereof raises one end of the cross bar 62 and its tongue 64 which now by the action of the spring 21 engages the edge 75 of the fuze housing 4 since the edge 76 of the firing pin lock 14 is no longer blocking the widened part 63 of the cross bar 62. When the tongue 64 leaves the edge 75 the cross bar 62 is given a possibility to move out whereby the widened part 63 thereof is moved into the recess 80 of the firing pin lock 14 and this movement is far enough for the cross bar 62 to loose its contact with the clock ring piston 30, whereby the firing pin lock 14 is moved such a distance outwards that the firing pin 16 is released from the slot 15 and with the pointed edge thereof hits the blasting cap 35.

As long as the fuze is in the safety position as shown in FIG. 4 the firing pin cannot be released as described above both because the widened part 63 of the cross bar 62 is contacting the edge 76 of the firing pin lock and also because the rocker 65 is blocked by the rocker catch 67. In the case the fuze is formed with a rocker as herein described a further function connection is suitable, viz. the following: When the firing pin lock 14 performs its first part movement the follower releaser 13 is released in that the rear edge of the firing pin lock is moved away from the bottom projection 81 of the follower releaser. Thereby the follower releaser is pushed downwards by the spring action obtained from the follower 8. This movement is stopped by the rocker catch 67 as soon as the projection 81 hits said catch. Provided the projection 81 has a suitable length there will be no power impulse actuating the rocker 65. Even without the said adaption of the projection length the follower releaser is stopped, however by the rocker 65, the end of which is positioned on top of the rocker catch 67. Even if this embodiment of the invention is acceptable the former is considered more suitable from the safety veiwpoint.

The above described release is accomplished at impact of the projectile by the action of the impact pin 61. The invention also may include a device for release so called "slow impact" which is obtained when the projectile is retarded in connection to impact. This device acts so that the force of inertia at impact is caused to actuate an impact piston 71 so as to be moved out of the normal position taken by the action of an impact spring 77 which with the upper end engages the fuze housing 4. When the upper edge of the impact piston 71 hits the tongue 64 of the cross bar 62 this is raised, whereby release follows as previously described in connection to release by means of impact pin 61 and rocker 65.

As long as the fuze is in safety position as shown in FIG. 4 no release can be obtained both because the widened part 63 of the cross bar 62 contacts the edge 76 of the firing pin lock 14 and also because the end 78 of the rocker catch 67 (see FIG. 4) is preventing the impact piston 71 from hitting the tongue 64 of the cross bar 62.

Figure 7:
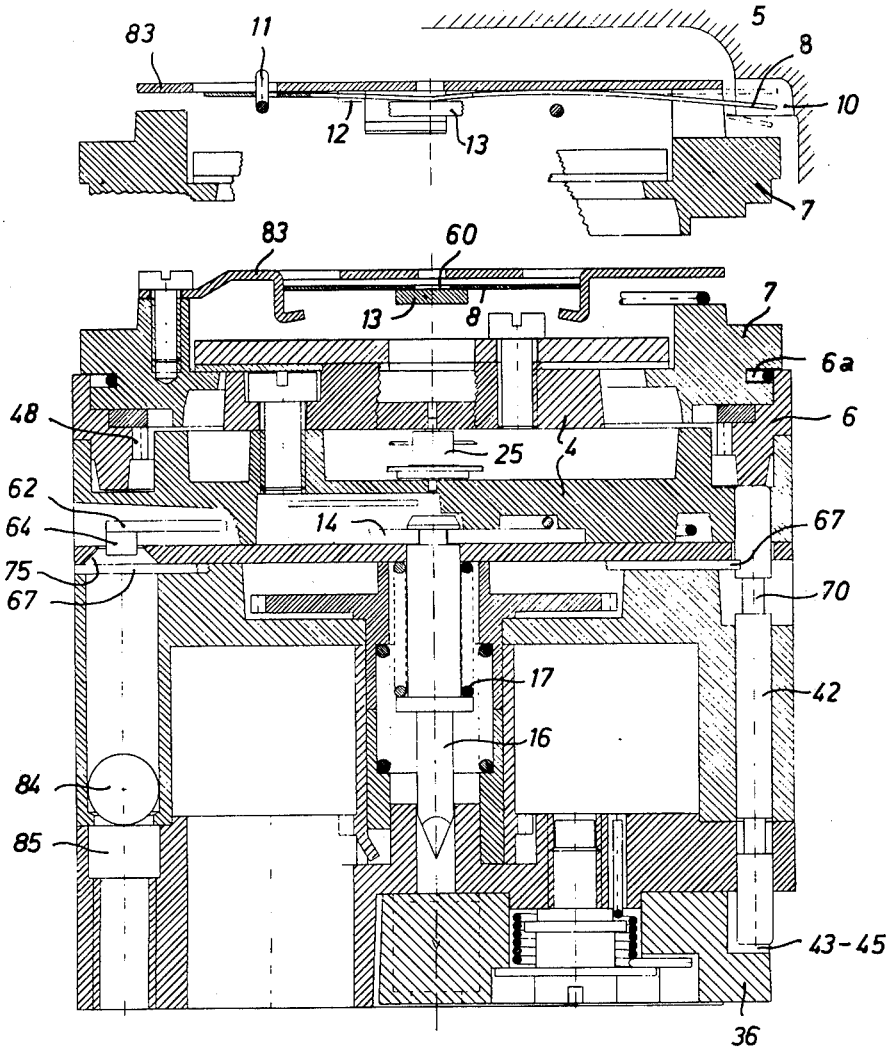
FIGS. 7 and 8 show two axial cross-sections through the fuze mchanism according to FIGS. 4–6.
Figure 8:
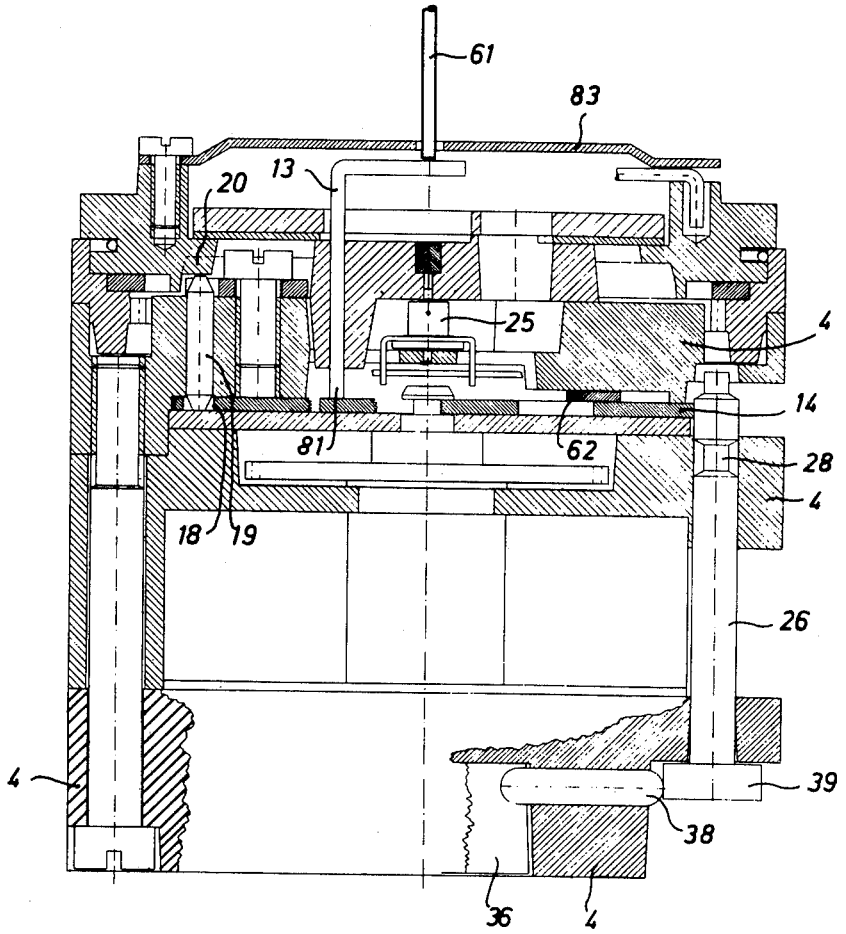

Without changing the above described functional connection the impact spring 77 may be replaced by a magnet positioned under the piston 71 and fixedly mounted in the fuze housing 4, whereby the impact piston is made of a magnetic material. The retardation forces occuring in the impact piston 71 at impact of the projectile are sufficient for the piston to disengage the magnet, whereby the piston moves forward and hits the tongue 64 with the same effect as previously described. The same effect is also obtained if the impact piston is replaced by a bullet of magnetic material. The latter embodiment is suitable if the projectile is of the rotating type. FIG. 7 is showing such an embodiment having a bullet 84 and a magnet 85.

Normally only one of the above described impact mechanisms is utilized, viz. the one having impact pin 61 or the one having impact piston 71 or bullet, but if wanted both mechanisms may of course be utilized at the same time.

In the case that the projectile is of the rotating type it may be provided with a further safety catch which is illustrated in FIGS. 4, 5 and 6 by way of two alternative embodiments. In one embodiment the rotor 36 is formed with a recess 72 in which a flexible tongue 73 engages. The tongue 73 is with the upper part thereof mounted in the fuze housing 4 and it is so dimensioned and has such properties that at rotation it will bend as far outwards due to the centrifugal action that it is no longer blocking the rotor. In such position the tongue 73 allows the rotor to be rotated to its armed position. If the projectile however for some reason should not rotate at sufficient speed the tongue forms a catch against rotation of the rotor in the direction towards armed position.

Alternatively the said centrifugal catch may be formed as an inwards spring biased piston 74 which due to centrifugal action at rotation of the projectile is thrown as far outwards as to permit the rotor to rotate to armed position.

The handling safety of the fuze is increased if both above described centrifugal catches are used in connection with each other whereby said catches are located in the fuze so that the force which is necessary for releasing one of the catches is directed at an angle of 180° against the direction of the force which is necessary for releasing the second catch. As previously mentioned the rotor 36 is spring biased for rotation. If the fuze is of the rotating type the biased spring may be replaced by an asymmetrical balance means for the rotors which at rotation provides a torque for the rotor 36.

It is to be understood that the embodiments of the invention described above and shown in the drawings are not restricting for the invention but are only illustrating examples and that all kinds of modifications may be presented within the scope of the appended claims.

We claim:

1. A fuze mechanism for projectiles and the like, which mechanism contains a clockwork (25) brought into operation when the projectile is launched and a blasting cap (35) which is rotated into registration with a firing pin (16) for detonating the fuze after a predetermined series of safety conditions have been met wherein the improvement comprises:

a firing pin lock (14) locking the firing pin and releasable in several successive steps from corresponding positions to unlock the firing pin;

manually adjustable means (19) for releasing the firing pin lock from a first position when the fuze is set or timed;

inertial means (26) for also releasing the firing pin lock from the first position in response to inertial forces generated while the projectile is launched;

a catch (24) connected with the clockwork to inhibit clockwork operation and responsive to preselected movement of the firing pin lock from the first position to release the clockwork and begin clockwork operation; and time responsive means (30) connected with the clockwork to release the firing pin lock from a second position at the end of a pre-set time whereby the firing pin is released at the end of the pre-set time to fire the blasting cap.

2. A fuze mechanism as defined in claim 1, wherein: rotary means (36) connected with the blasting cap is provided for moving the cap into alignment with the firing pin; and the inertial means (26) comprises a piston which is releasably engaged with both the firing pin lock and the rotary means to release the lock and rotary means when the projectile is launched.

3. A fuze mechanism as defined in claim 1, wherein:

a cross bar (62) engages the firing pin lock for releasing the lock; and impact means (71) responsive to the clockwork and engageable with the cross bar is provided for releasing the cross bar and the firing pin lock in response to strong retardation of the projectile after a lapse of some part of the pre-set time of the clockwork whereby the firing pin may be released independently of the time responsive means (30).

4. A fuze mechanism as defined in claim 1 wherein the manually adjustable means (19) comprises a locking piston responsive to the setting of the fuze time for releasing the firing pin lock (14).

5. A fuze mechanism as defined in claim 1 further including an impact firing means having an impact pin (61) projecting from the fuze mechanism and responsive to projectile impact, and releasing means (13, 62, 65) connected between the impact pin and the firing pin lock (14) and responsive to the impact pin movement for releasing the lock after launching of the projectile and in response to projectile impact.

6. A fuze mechanism as defined in claim 5 further including a catch (67) cooperating with the release means and responsive to the time responsive means (30) and the clockwork (25) for preventing release of the firing pin lock (14) in response to the impact pin (61) for a predetermined interval after launch of the projectile.

7. A fuze mechanism as defined in claim 10 wherein:

the time responsive means includes a stop member (30) engageable with the firing pin lock, and two rings (6, 7) frictionally engaged with one another for rotation relative to one another in opposition to friction forces and connected with the clockwork for rotation as a unit, the one ring (6) having a shoulder (34) engageable with the stop member for release of the member after a first increment of rotation, the other (7) of the rings having a groove (33) registrable with said stop member for releasing the member after the pre-set time and the firing pin lock at the second position to permit the firing pin to detonate the blasting cap.

8. A fuze mechanism as defined in claim 7 wherein:

rotatable means (36) supports the blasting cap for rotation into alignment with the firing pin; and a rotor piston (42) extends between the rotatable means and one of the rings (7) rotated by the clockwork to control the rotation of the blasting cap into alignment with the firing pin.

9. A fuze mechanism as defined in claim 7 wherein:

a follower (8) releasably interlocks one (6) of the two rings (6, 7) with the projectile housing (5) to prevent rotation of the said one ring (6) relative to the housing prior to release of the firing pin lock (14) from the first position by the inertia means (26) whereby the one ring (6) is prevented from being rotated before the projectile is launched and is permitted to be rotated by the clockwork after the projectile is launched.

* * * * *

UNITED STATES PATENT OFFICE

CERTIFICATE OF CORRECTION

Patent No. 3,978,798 Dated September 7, 1976

Inventor(s) Kaj Backström, Rolf V. Grahn, Per O.T.V. Hedenmark, Kjell G. Öhrstedt It is certified that error appears in the above-identified patent and that said Letters Patent are hereby corrected as shown below:

Abstract, line 7, delete "response" and substitute --responsive--.

Column 1, line 45, delete "inventin" and substitute --invention--.

Column 3, line 53, delete "piston 40" and substitute --piston 30--.

Column 6, line 38, delete "tempering" and substitute --timing--.

Column 7, line 4, delete "puut" and substitute --put--.

Column 9, line 51, delete "biased" and substitute --biasing--.

Claim 7, line 1, delete "claim 10" and substitute --claim 1--.

Signed and Sealed this

Second Day of November 1976

[SEAL]

*Attest:*

RUTH C. MASON
*Attesting Officer*

C. MARSHALL DANN
*Commissioner of Patents and Trademarks*